US009550362B2

(12) United States Patent
Kumagai

(10) Patent No.: US 9,550,362 B2
(45) Date of Patent: Jan. 24, 2017

(54) MIST COLLECTION DEVICE, LIQUID EJECTING APPARATUS, AND METHOD FOR CONTROLLING MIST COLLECTION DEVICE

(71) Applicant: SEIKO EPSON CORPORATION, Tokyo (JP)

(72) Inventor: Toshio Kumagai, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/570,537

(22) Filed: Dec. 15, 2014

(65) Prior Publication Data

US 2015/0097895 A1 Apr. 9, 2015

Related U.S. Application Data

(63) Continuation of application No. 13/158,922, filed on Jun. 13, 2011.

(30) Foreign Application Priority Data

Jul. 8, 2010 (JP) ..... 2010-155492

(51) Int. Cl.
*B41J 2/165* (2006.01)
*B41J 2/17* (2006.01)

(52) U.S. Cl.
CPC ..... *B41J 2/16517* (2013.01); *B41J 2/1714* (2013.01)

(58) Field of Classification Search
None
See application file for complete search history.

(56) References Cited

U.S. PATENT DOCUMENTS 4,361,845 A 11/1982 Smith
5,774,141 A 6/1998 Cooper et al.
6,293,196 B1 * 9/2001 DeMoore ..... B41F 23/0426 101/416.1
6,390,618 B1 5/2002 Wotton et al.
6,945,628 B2 * 9/2005 Koitabashi ..... B41J 2/1714 347/34
7,044,581 B2 5/2006 Shimoyama
2002/0167576 A1 * 11/2002 Koitabashi ..... B41J 2/1714 347/101

(Continued)

FOREIGN PATENT DOCUMENTS

CN 102310636 1/2012
EP 1652675 A1 5/2006

(Continued)

OTHER PUBLICATIONS

U.S. Appl. No. 13/158,922, Sep. 19, 2012, Office Action.

(Continued)

*Primary Examiner* — Alejandro Valencia
(74) *Attorney, Agent, or Firm* — Workman Nydegger

(57) ABSTRACT

A mist collection device capable of suctioning and recovering mist generated at the time of ejecting a liquid is disclosed. The mist collection device includes an exhaust duct having a suction portion which is installed to extend downwardly to suction external air. The suction portion is provided with a suction port extending in a vertical direction, and an upper end portion, which communicates with the exhaust duct, of the suction portion is installed to protrude in an annular shape from an inner bottom portion of the exhaust duct.

3 Claims, 4 Drawing Sheets

(56) References Cited

U.S. PATENT DOCUMENTS

| | | | | |
|---|---|---|---|---|
| 2006/0092217 | A1 | 5/2006 | Valles et al. | |
| 2007/0109348 | A1* | 5/2007 | Izawa et al. | 347/34 |
| 2011/0069115 | A1 | 3/2011 | Tanabe et al. | |
| 2011/0181658 | A1* | 7/2011 | Izawa | B41J 2/155 347/34 |
| 2012/0001985 | A1 | 1/2012 | Kumagai | |
| 2012/0007916 | A1 | 1/2012 | Kumagai | |
| 2015/0062243 | A1 | 3/2015 | Kumagai | |

FOREIGN PATENT DOCUMENTS

| | | |
|---|---|---|
| JP | 06-022743 | 3/1994 |
| JP | 3064004 | 12/1999 |
| JP | 2001-080094 | 3/2001 |
| JP | 2005-271314 | 10/2005 |
| JP | 2005-271316 | 10/2005 |
| JP | 2006-123555 | 5/2006 |
| JP | 2008-213310 | 9/2008 |
| JP | 2012-016880 | 1/2012 |

OTHER PUBLICATIONS

U.S. Appl. No. 13/158,922, Jan. 8, 2013, Final Office Action.
U.S. Appl. No. 13/158,922, May 30, 2014, Office Action.
U.S. Appl. No. 13/158,922, Sep. 17, 2014, Final Office Action.

* cited by examiner

MIST COLLECTION DEVICE, LIQUID EJECTING APPARATUS, AND METHOD FOR CONTROLLING MIST COLLECTION DEVICE

CROSS-REFERENCE TO RELATED APPLICATIONS

The present application is a Continuation of U.S. patent application Ser. No. 13/158,922 filed on Jun. 13, 2011, which claims priority to Japanese Patent Application No. 2010-155492, filed Jul. 8, 2010, which applications are hereby incorporated by reference in their entirety.

BACKGROUND

1. Technical Field

The present invention relates to a mist collection device, a liquid ejecting apparatus, and a method for controlling the mist collection device.

2. Related Art

Ink jet printers are widely known as a liquid ejecting apparatus which ejects a liquid onto a medium in the related art. In such a printer, there is a printer capable of performing a printing process by ejecting ink (liquid) onto a transported paper sheet (medium) from nozzles provided in a liquid ejecting head (for example, JP-A-2005-271316).

The printer disclosed in JP-A-2005-271316 includes an exhaust duct and an exhaust fan so as to recover mist generated when the ink is ejected.

Meanwhile, the printer disclosed in JP-A-2005-271316 includes a movable cap for receiving liquid droplets, and a wiper for sweeping the inside of the exhaust duct so as to suppress the mist, which is adhered to an inside wall of the exhaust duct, from flowing down and running down as liquid droplets to stain the paper sheet.

However, if the cap and the wiper are provided, the configuration thereof becomes complicated. Since the inside of the exhaust duct should be frequently swept to prevent the liquid from running down, there is a problem in that the maintenance is inconvenient. For this reason, there has been demand to recover the mist while suppressing the liquid from running down from the exhaust duct.

SUMMARY

An advantage of some aspects of the invention is to provide a mist collection device, a liquid ejecting apparatus, and a method for controlling the mist collection device which can suppress a liquid from running down from an exhaust duct.

According to an aspect of the invention, there is provided a mist collection device capable of suctioning and recovering mist generated at the time of ejecting a liquid, the mist collection device including an exhaust duct having a suction portion which is installed to extend downwardly so as to suction external air, wherein the suction portion is provided with a suction port extending in a vertical direction, and an upper end portion, which communicates with the exhaust duct, of the suction portion is installed to protrude in an annular shape from an inner bottom portion of the exhaust duct.

With the configuration, the mist generated at the time of ejecting the liquid can be recovered to the inside of the exhaust duct through the suction portion. In this instance, since the suction port formed in the suction portion is formed in the shape extending in the vertical direction, it does not disturb or block the flow of the air which is suctioned in the exhaust duct. That is, if the suction port is bent or a stepped portion is formed at the suction portion, the gas collides with the bent portion or the stepped portion, so that the mist is adhered thereto. The flow of the air stream in the suction port is not disturbed, thereby suppressing the adhesion of the liquid droplets which causes the liquid to run down. The exhaust duct communicates with the external air through the suction portion, but the upper end portion of the suction portion is installed to protrude from the inner bottom portion of the exhaust duct in the annular shape. The liquid recovered in the exhaust duct does not run down from the inside of the exhaust duct by the upper end portion of the suction portion. Consequently, it is possible to easily collect and discharge the recovered liquid on the inner bottom portion of the exhaust duct, thereby suppressing the liquid from running down from the exhaust duct.

In the mist collection device according to the aspect of the invention, the suction port may be formed in a taper shape such that an opening area thereof is decreased toward an upper end side from a lower end side.

With the configuration, since the suction port formed in the suction portion is formed in the taper shape of which the opening area is decreased toward the upper end side from the lower end side, the wind velocity of the air stream flowing in the suction port is increased as it moves from the lower end side to the upper end side. The liquid droplets adhered to the suction portion are combined to become larger liquid droplets in the process of being pushed up by the air stream. Since the wind velocity is gradually increased toward the upper end side, the enlarged liquid droplets can be recovered in the exhaust duct without being dropped.

In the mist collection device according to the aspect of the invention, the suction portion may be subjected to a water repellency treatment.

With the configuration, since the suction portion is subjected to the water repellency treatment, it can accelerate the movement of the adhered liquid, thereby effectively recovering the liquid in the exhaust duct.

The mist collection device according to the aspect of the invention may further include an exhaust fan which exhausts air inside the exhaust duct, wherein the exhaust fan may be installed at one end side of the exhaust duct in a horizontal direction, and the suction portion is installed to extend downwardly from a bottom portion of the exhaust duct at the other end side of the exhaust duct in the horizontal direction.

With the configuration, the suction portion is installed to extend downwardly from the bottom portion of the exhaust duct, but the exhaust fan is installed at one end side of the exhaust duct in the horizontal direction, the mist recovered in the exhaust duct through the suction portion is carried in the horizontal direction. Accordingly, since the length of the suction portion is set to be shorter than that of the exhaust duct, it is possible to suppress the liquid from running down.

The mist collection device according to the aspect of the invention may further include a control unit which controls the exhaust fan, wherein when ejection of the liquid is completed, the control unit increases the number of revolutions of the exhaust fan to drive the exhaust fan, in which the number of revolutions is higher than that at the time of ejecting the liquid, and then may stop driving of the exhaust fan.

With the configuration, the exhaust fan is driven at the number of revolutions higher than that at the time of ejecting the liquid, so that the liquid droplets adhered to the suction portion can be recovered to the inside of the exhaust duct. Accordingly, it is possible to suppress the liquid from running down while the driving of the exhaust fan is stopped. Meanwhile, at the time of ejecting the liquid, the number of revolutions of the exhaust fan is suppressed to a low level so that the liquid does not run down and drop.

According to another aspect of the invention, there is provided a liquid ejecting apparatus including a liquid ejecting head having a nozzle which ejects a liquid onto a medium, and the mist collection device.

With the configuration, the mist generated at the time of ejecting the liquid can be recovered by the mist collection device. The mist collection device suppresses the liquid from running down from the exhaust duct, thereby suppressing the contamination of the medium due to the liquid running down and dropping.

In the liquid ejecting apparatus according to the aspect of the invention, the medium may be transported along a transport direction, and the liquid ejecting head may be disposed at an upper side of the medium in a transport path thereof; and the exhaust duct may be disposed at a downstream side of the liquid ejecting head in the transport direction, and the suction portion may be installed to extend toward the medium side.

With the configuration, since the medium is transported along the transport direction, the air stream is generated in the flow direction of the transport direction according to the transport of the medium. In addition, since the liquid ejecting head is disposed at the upstream side of the transport passage of the medium, the mist generated at the time of ejecting the liquid is carried to the downstream side of the transport direction along the air stream. Further, since the exhaust duct is disposed at the downstream side of the transport direction of the liquid ejecting head, it is possible to effectively recover the mist flowing in the transport direction along the air stream. In addition, if the suction portion is installed to extend around the nozzle, the flight direction of the ejected liquid may be disturbed. However, since the suction portion is installed to extend toward the medium, it is possible to recover the mist without disturbing the flight direction of the liquid.

In the liquid ejecting apparatus according to the aspect of the invention, the exhaust duct may be disposed at the upper side of the medium in the transport path, and a lower end portion of the suction portion may be installed to extend to a position where a downstream side rather than an upstream side in the transport direction comes close to the medium.

With the configuration, the lower end portion of the suction portion is installed in such a way that the downstream side in the transport direction is extended to the position adjacent to the medium. The extended portion changes the flow direction of the air stream, so that the mist contained in the air stream can be effectively recovered to the inside of the exhaust duct through the suction portion.

According to still another aspect of the invention, there is provided a method for controlling the mist collection device including suctioning external air containing mist in an exhaust duct by driving an exhaust fan at the time of ejecting a liquid; recovering the liquid adhered to a suction portion into the exhaust duct by increasing the number of revolutions of the exhaust fan to higher than that at the time of ejecting the liquid and driving the exhaust fan, when ejection of the liquid is completed; and stopping driving of the exhaust fan after the recovering of the liquid.

With the configuration, at the time of ejecting the liquid, it is possible to suction the mist, which is generated at the time of ejecting the liquid, by the driving of the exhaust fan. In addition, when the ejection of the liquid is completed, since the exhaust fan is driven at the number of revolutions higher than that at the time of ejecting the liquid, the liquid adhered to the suction portion can be recovered to the inside of the exhaust duct. Consequently, after the ejection and suction of the liquid is stopped, as well as ejecting the liquid which generates the mist, it is possible to suppress the liquid from running down from the exhaust duct.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
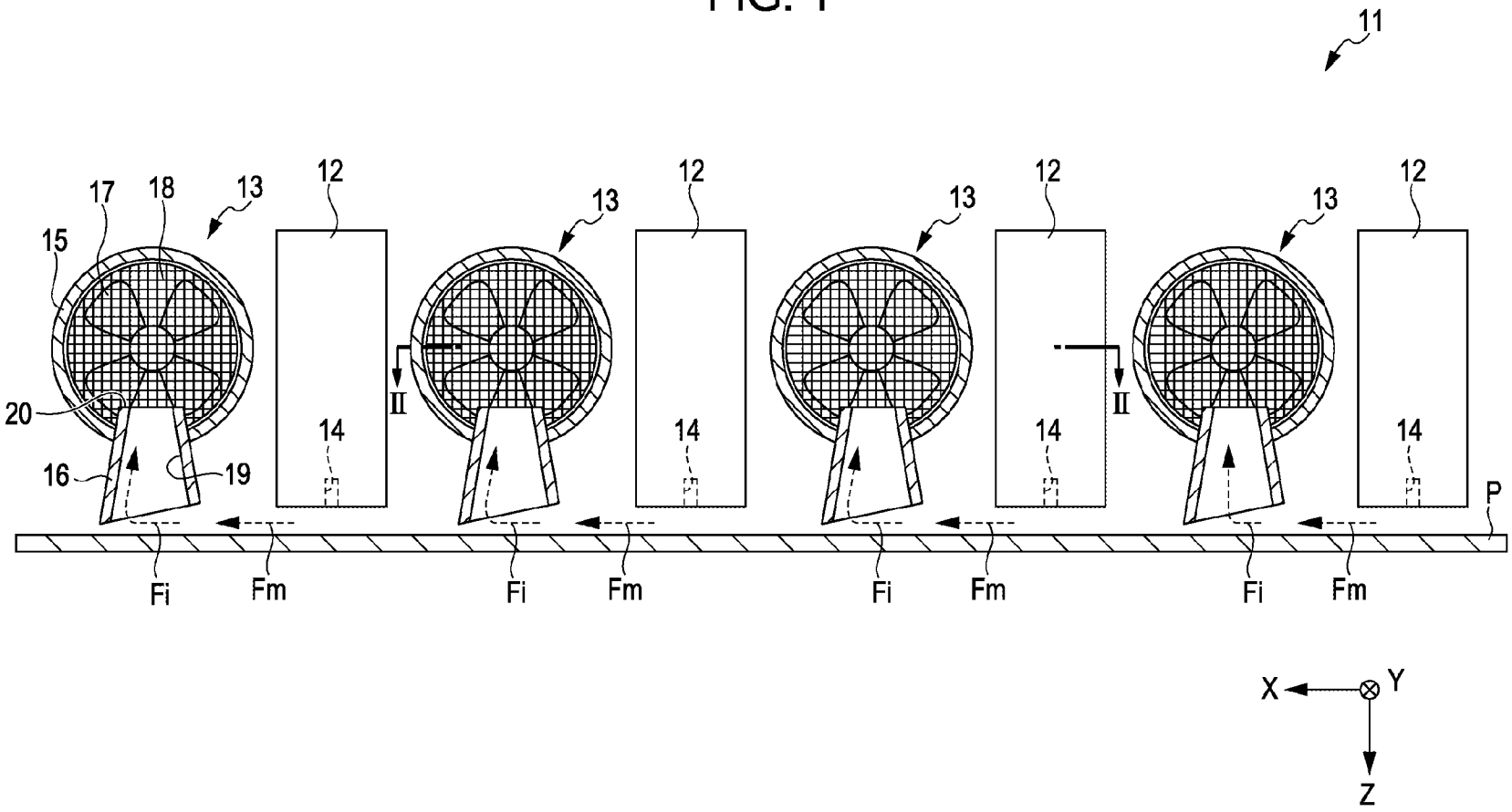
FIG. 1 is a cross-sectional view illustrating the schematic configuration of a printer according to an embodiment.

Below, an embodiment, in which the invention is exemplified as an ink jet printer (hereinafter, referred to as a printer) which is a kind of a liquid ejecting apparatus, will be described. In the specification and drawings, an arrow X direction is set to a left direction, a −X direction is set to a right direction, an arrow Y direction is set to a rearward direction, a −Y direction is set to a forward direction, an arrow Z direction is set to a downward direction which is a gravitational direction, and a −Z direction is set to an upward direction. In addition, a direction including the X direction and the −X direction is referred to as a horizontal direction or an X-axis direction, a direction including the Y direction and the −Y direction is referred to as a front-back direction or Y-axis direction, and a direction including the Z direction and the −Z direction is referred to as a vertical direction or a Z-axis direction. In the drawings, an arrow marked by "×" inside "○" indicates a direction heading from a surface of a paper to a rear surface.

As shown in FIG. 1, a printer 11 includes a liquid ejecting head 12 for suctioning and ejecting ink as a liquid, a mist collection device 13 for recovering mist generated at the time of ejecting the ink, and a transport device which is not illustrated. The transport device is adapted to transport a paper sheet P as a medium in a transport direction X, and may employ a pair of transport rollers for transporting the paper sheet, with the paper sheet P being pinched therebetween, or a transport belt for suctioning and transporting the paper sheet P.

The liquid ejecting head 12 are arranged in plurality (four in this embodiment) at predetermined intervals along a transport path of the paper sheet P. In this instance, the number of liquid ejecting heads 12 can be arbitrarily changed. In addition, each of the liquid ejecting heads 12 is provided with nozzles 14 which form ejection ports for the ink.

Each of the liquid ejecting heads 12 is disposed at an upstream side of the transport path of the paper sheet P. While the paper sheet P is transported in the transport direction X, the upper surface of the paper sheet receives the ink ejected from each of the liquid ejecting heads 12 to perform the printing (recording) process.

Figure 2:
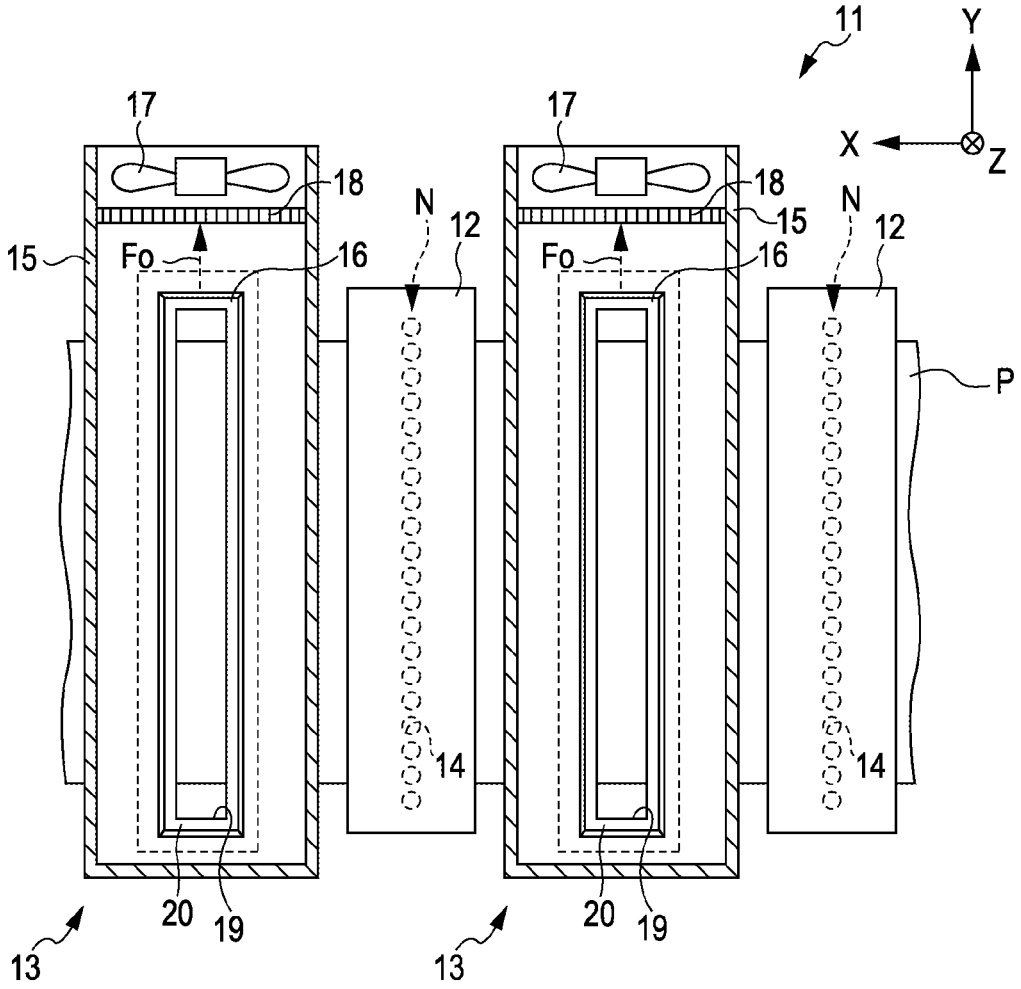
FIG. 2 is a cross-sectional view taken along the arrow II-II in FIG. 1.

As shown in FIG. 2, the nozzles 14 are provided in plurality so as to cover the entire width of the paper sheet P according to the Y-axis direction which is a widthwise direction of the paper sheet P. In addition, each of the nozzles 14 arranged in parallel with the Y-axis direction forms a nozzle row N which ejects the same ink. That is, the printer 11 is a printer of a line head type which is capable of performing the printing over the entire width of the paper sheet P without the movement of the liquid ejecting head 12.

The mist collection device 13 is disposed at a downstream side of each of the liquid ejecting heads 12 in the transport direction X. In addition, the mist collection device 13 includes an exhaust duct 15, a suction portion 16, installed at the exhaust duct 15, for suctioning external air, an exhaust fan 17 for exhausting gas in the exhaust duct 15, and a filter 18.

The exhaust duct 15 is extended in the Y-axis direction which is approximately a horizontal direction, and is disposed at an upper side of the transport passage of the paper sheet P. The exhaust fan 17 is installed at one end side (rear end side) of the exhaust duct 15 in the Y-axis direction.

As the exhaust fan 17 is rotated, an air stream Fo flows in an exhaust direction Y in the exhaust duct 15. In addition, the filter 18 is disposed at the upstream side of the exhaust fan 17 in the exhaust direction Y, and separates floating matters such as mist from the air stream Fo.

The suction portion 16 is installed to extend downwardly toward the upper surface side of the paper sheet P from a bottom portion of the exhaust duct 15 at the other end side (front end side) of the exhaust duct 15 in the Y-axis direction. In addition, the suction portion 16 is provided with a suction port 19 extending in the vertical direction. In this instance, the suction portion 16 and the suction port 19 have the length corresponding to the nozzle row N in the Y-axis direction.

As shown in FIG. 1, the suction portion 16 is connected to the exhaust duct 15 by inserting an upper end portion of the suction portion into a hole which is formed in the bottom portion of the exhaust duct 15. The upper end portion of the suction portion 16 is provided with a protrusion portion 20 which is installed to protrude from the inner bottom portion of the exhaust duct 15 in an annular shape so as to enclose the suction port 19. In addition, the length of the suction portion 16 in the Z-axis direction (vertical direction) is shorter than the length of the exhaust duct 15 in the Y-axis direction.

The suction port 19 is formed in a taper shape of which the opening area is decreased toward an upper end side from an lower end side. In this instance, the inside wall of the suction portion 16 forming the suction port 19 is subjected to liquid repellency treatment. In addition, the lower end portion of the suction portion 16 is installed to extend to a position where the downstream side rather than the upstream side in the transport direction X comes close to the paper sheet P.

Next, the electrical configuration of the printer 11 will be described.

Figure 3:
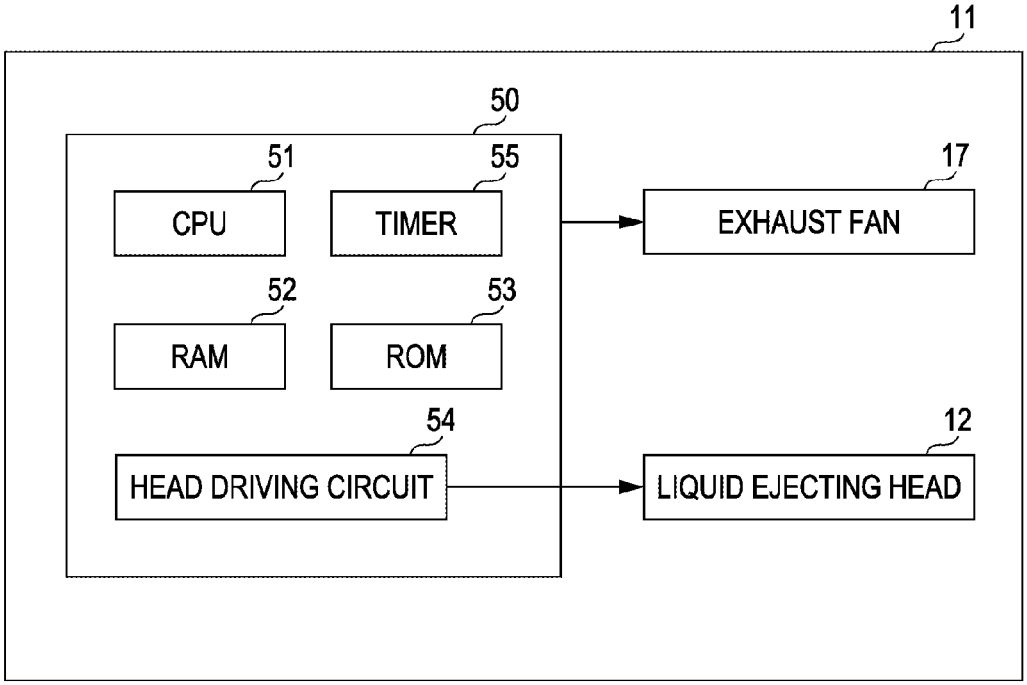
FIG. 3 is a block diagram illustrating the electrical configuration of a printer according to an embodiment.

As shown in FIG. 3, the printer 11 includes a control device 50 as a control unit. The control device 50 has a CPU 51, a RAM 52, a ROM 53, a head driving circuit 54, and a timer 55.

The ROM 53 stores a control program executed by the CPU 51, data for a threshold value which is referenced in the execution of the control program, or the like. In addition, the RAM 52 temporarily stores operation results of the CPU 51, various data or the like for executing the control program.

The control device 50 controls the ejecting operation of the ink by the liquid ejecting head 12 through the head driving circuit 54. In addition, the control device 50 controls the exhaust fan 17. The exhaust fan 17 is adapted to vary the number of revolutions under the control of the control device 50. Further, the control device 50 or the CPU 51 or the like may be installed in plurality in accordance with the control contents thereof, and for example, may include a control device for performing only the control of the mist collection device 13.

Next, the operation of the printer 11 will be described.

As shown in FIG. 1, an air stream Fm (transport air stream) is generated in the printer 11 according to the transport of the paper sheet P, and the transport direction X is a flow direction of the air stream. In addition, if the mist of the ink is generated around each nozzle 14 according to the ejection of the ink from each of the liquid ejecting heads 12, the mist is carried toward the downstream side of the transport direction X along the air stream Fm.

If the mist is adhered to the liquid ejecting heads 12 positioned at the downstream side or the like, the liquid ejecting heads become stained. Accordingly, in the printer 11, the mist generated at the time of ejecting the ink is recovered by the mist collection device 13.

Specifically, the exhaust fan 17 is driven to generate the air stem Fo in the exhaust duct 15, and an air stream Fi upwardly flowing in the suction port 19 is generated by the air stream Fo. Since the air stream Fm is suctioned in the suction port 19 by the air stream Fi, the mist contained in the air stream Fm are recovered in the exhaust duct 15.

Herein, since the suction port 19 is formed in the taper shape, the flow speed of the air stream Fi is increased by the upward flow. In addition, since the suction portion 16 is subjected to the water repellency treatment, if the ink is adhered to the suction portion, the mist becomes liquid droplets. In this instance, it is desirable that the suction portion 16 is formed such that a contact angle between the ink and the suction portion by the water repellency treatment is set to be 40 degrees or more. As the liquid droplets adhered to the suction portion 16 are carried in the upward direction by the air stream Fi, the liquid droplets are combined to become larger liquid droplets. In this instance, the increased flow speed of the air stream Fi suppresses the liquid droplets with increased weight from being dropped, so that the liquid droplets are recovered in the exhaust duct 15.

The ink recovered in the exhaust duct 15 is collected on the inner bottom portion of the exhaust duct 15 by its own weight, but is blocked by the protrusion portion 20. The collected liquid droplets do not fall onto the paper sheet P through the suction port 19, and are maintained in the exhaust duct 15. In addition, the liquid droplets collected on the inner bottom portion of the exhaust duct 15 are discharged through an opening formed in the rear end side (downstream side in the exhaust direction Y) of the exhaust duct 15. In this instance, in order to easily discharge the ink which is collected on the inner bottom portion of the exhaust duct 15, the exhaust duct 15 or the inner bottom portion thereof may also be inclined downwardly toward the rear side from the front side.

In the printer 11, if the mist collection device 13 suctions the mist excessively strongly while the paper sheet P is printing, a flight direction of the ink droplets with respect to the paper P may be disturbed. Therefore, it is not preferable. Accordingly, in order to drive the exhaust fan 17, the control device 50 suppresses the number of revolutions of the exhaust fan 17 to a certain extent so as not to run down and drop the ink droplets from the exhaust portion 16 when the paper sheet P is printed.

If the printing is completed at this state and the exhaust fan 17 is stopped, the ink adhered to the suction portion 16 may be dropped onto the paper sheet P or the transport passage due to its own weight. For this reason, when the ejection of the ink by the liquid ejecting head 12 is completed, the control device 50 increases the number of revolutions of the exhaust fan 17 to higher than that when the ink is ejected from the liquid ejecting head 12, to drive the exhaust fan 17, and then stops the driving of the exhaust fan 17. That is, if the printing is completed, since the printing quality is not deteriorated even though the strong suction is performed, the suction is performed by a stronger suction force than that at the time of printing to recover the ink droplets adhered to the suction portion 16 to the inside of the exhaust duct 15.

Next, the process of executing the recovery of the mist by the mist collection device 13 under the control device 50 in the printer 11 will be described.

Figure 4:
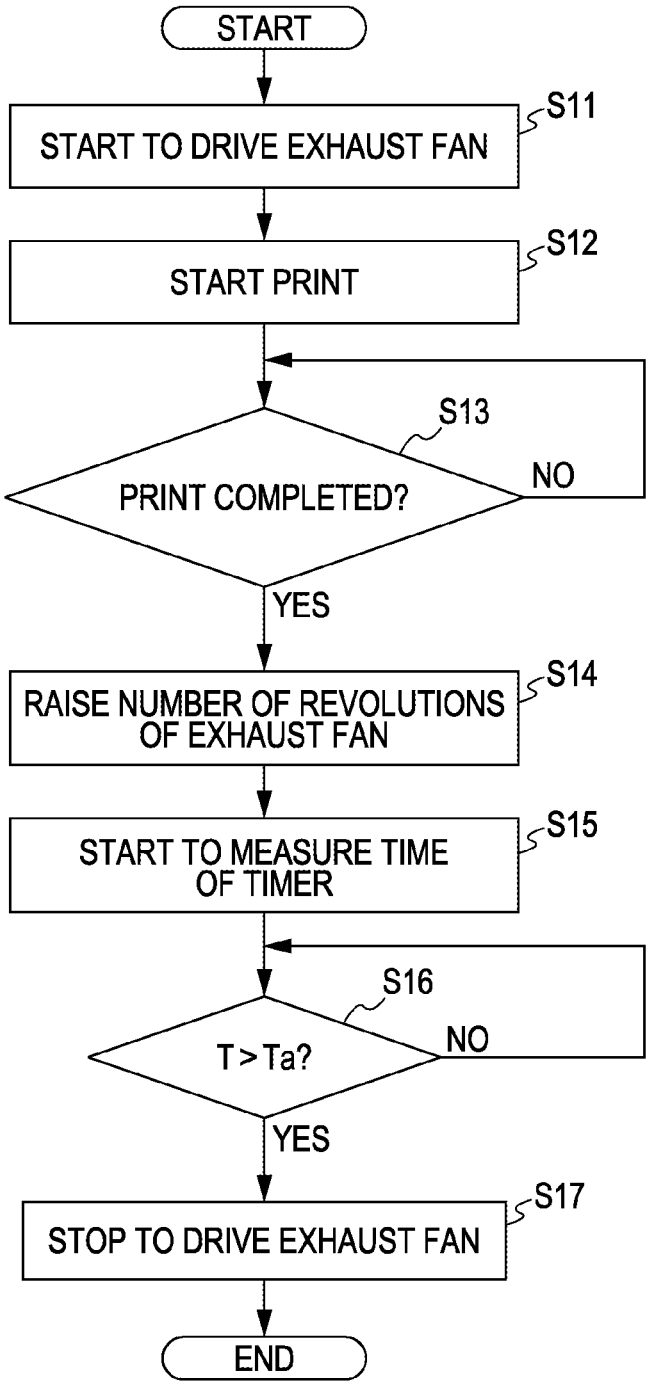
FIG. 4 is a flowchart illustrating a process when recovery of mist is performed.

As shown in FIG. 4, if the control device 50 receives a printing command from a host computer (not illustrated) or the like, the control device starts to drive the exhaust fan 17 in step S11. In addition, the control device 50 controls the liquid ejecting head 12 to start the printing in the subsequent step S12. That is, in the state in which the outflow of the ink recovered in the exhaust duct 15 is suppressed by the protrusion portion 20 which is installed to protrude from the inner bottom portion of the exhaust duct 15 in an annular shape so as to enclose the suction port 19, the control device drives the exhaust fan 17 to suction the external air including the mist to the inside of the exhaust duct 15 (mist recovering process).

Next, in step S13, the control device 50 determines whether the printing based on the printing command is completed or not. If the printing is not completed, the determination of step S13 is repeated.

Meanwhile, if the control device 50 determines that the printing is completed in step S13, the control device 50 proceeds to step S14, in which the exhaust fan 17 is driven at the number of revolutions higher than that when the liquid ejecting head 12 ejects the ink. That is, when the ejection of the ink is completed, the exhaust fan 17 is driven at the number of revolutions higher than that at the time of ejecting the ink, such that the liquid droplets adhered to the suction portion 16 are recovered to the inside of the exhaust duct 15 by the strong suction force (liquid recovering process).

Next, in step S15, the control device 50 starts to measure the time by use of the timer 55.

Subsequently, in step S16, the control device 50 determines whether the time T measured by the timer 55 exceeds a threshold value Ta. If the measured time T is equal to or less than the threshold value Ta, the determination of step S16 is repeated.

Meanwhile, if the time T measured by the timer 55 exceeds the threshold value Ta, the control device 50 proceeds to step S17, in which the driving of the exhaust fan 17 is stopped (stopping process), and the processing is completed. In this instance, the threshold value Ta is a time to recover the ink adhered to the suction port 19 to the inside of the exhaust duct 15. The threshold time may be prescribed based on a test or the like in advance, and then be stored in the ROM 53.

According to the embodiment described above, the following effects can be obtained.

(1) The mist generated at the time of ejecting the ink can be recovered to the inside of the exhaust duct 15 through the suction portion 16. In this instance, since the suction port 19 formed in the suction portion 16 is formed in the shape of extending in the vertical direction, it does not disturb or block the flow of the air which is suctioned in the exhaust duct 15. That is, if the suction port 19 is bent or a stepped portion is formed at the suction portion 16, the mist collides with the bent portion or the stepped portion, so that the liquid droplets are adhered thereto. In particular, in a case where the extended suction portion 16 suctions not the mist dispersed in the space but the thick mist just generated by the ejection, the liquid droplets are likely to adhere to the bent portion or the like. In this regard, the flow of the air stream Fi in the suction port 19 is not disturbed, thereby suppressing the adhesion of the liquid droplets which causes the liquid to run down.

(2) The exhaust duct 15 communicates with the external air through the suction portion 16, but the upper end portion of the suction portion 16 is installed to protrude from the inner bottom portion of the exhaust duct 15 in the annular shape. The ink recovered in the exhaust duct 15 does not run down from the inside of the exhaust duct 15 by the upper end portion of the suction portion 16. Consequently, it is possible to easily collect and discharge the recovered ink on the inner bottom portion of the exhaust duct 15, thereby suppressing the liquid from running down from the exhaust duct 15.

(3) Since the suction port 19 formed in the suction portion 16 is formed in the taper shape of which the opening area is decreased toward the upper end side from the lower end side, the wind velocity of the air stream Fi flowing in the suction port 19 is increased as it moves from the lower end side to the upper end side. The liquid droplets adhered to the suction portion 16 are combined to become larger liquid droplets in the process of being pushed up by the air stream Fi. Since the wind velocity is gradually enlarged toward the upper end side, the increased liquid droplets can be recovered in the exhaust duct 15 without being dropped.

(4) Since the suction portion 16 is subjected to the water repellency treatment, it can accelerate the movement of the adhered ink, thereby effectively recovering the ink in the exhaust duct 15.

(5) The suction portion 16 is installed to extend downwardly from the bottom portion of the exhaust duct 15, but since the exhaust fan 17 is installed at one end side of the exhaust duct 15 in the horizontal direction (exhaust direction Y), the mist recovered in the exhaust duct 15 through the suction portion 16 is carried in the horizontal direction (exhaust direction Y). Since the length of the suction portion 16 in the Z-axis direction is shorter than that of the exhaust duct 15 in the exhaust direction Y, it is possible to suppress the liquid from running down.

(6) The exhaust fan 17 is driven at the number of revolutions higher than that at the time of ejecting the ink, so that the ink adhered to the suction portion 16 can be recovered to the inside of the exhaust duct 15. Accordingly, it is possible to suppress the liquid from running down while the driving of the exhaust fan 17 is stopped. Meanwhile, at the time of ejecting the ink, the number of revolutions of the exhaust fan 17 is suppressed to a low level so that the ink does not run down and drop, thereby suppressing the flight direction of the ink being from disturbed.

(7) The mist generated at the time of ejecting the ink can be recovered by the mist collection device 13. The mist collection device 13 suppresses the liquid from running down from the exhaust duct 15, thereby suppressing the contamination of the paper sheet P due to the ink running down and dropping.

(8) Since the paper sheet P is transported along the transport direction X, the air stream Fm is generated in the flow direction of the transport direction X according to the transport of the paper sheet P. In addition, since the liquid ejecting head 12 is disposed at the upstream side of the transport passage of the paper sheet P, the mist generated at the time of ejecting the ink is carried to the downstream side of the transport direction X along the air stream Fm. Further, since the exhaust duct 15 is disposed at the downstream side of the liquid ejecting head 12 in the transport direction X, it is possible to effectively recover the mist flowing in the transport direction X along the air stream Fm.

(9) If the suction portion 16 is installed to extend around the nozzle 14, it is possible to disturb the flight direction of the ejected ink. However, since the suction portion 16 is installed to extend toward the paper sheet P, it is possible to recover the mist without disturbing the flight direction of the ink.

(10) The lower end portion of the suction portion 16 is installed in such a way that the downstream side in the transport direction X is extended to the position adjacent to the paper sheet P. The extended portion changes the flow direction of the air stream Fm, so that the mist contained in the air stream Fm can be effectively recovered to the inside of the exhaust duct 15 through the suction portion 16.

(11) At the time of ejecting the ink, it is possible to suction the mist, which is generated by ejecting the ink, by the driving of the exhaust fan 17. In addition, when the ejection of the ink is completed, since the exhaust fan 17 is driven at the number of revolutions higher than that at the time of ejecting the ink, the liquid droplets of the ink adhered to the suction portion 16 can be recovered to the inside of the exhaust duct 15. Consequently, after the ejection and suction of the ink is stopped, as well as ejecting the ink which generates the mist, it is possible to suppress the liquid from running down from the exhaust duct 15.

In this instance, the above-described embodiment can be altered as follows.

The liquid ejecting head 12 is not limited to one where the ink is ejected immediately below the liquid ejecting head which coincides with the gravitational direction Z. For example, the liquid ejecting head may be adapted to eject the ink in the diagonally downward direction toward the paper sheet P which is obliquely transported. In addition, in each drawing, the transport direction X, the exhaust direction Y, and the gravitational direction Z are shown so as to intersect each other, but the intersection angle of each direction may be not a right angle.

The transport path of the paper sheet P may be not formed in a straight shape when seen from the front. For example, the paper sheet P can be transported while it is wound around a cylindrical support member.

The suction portion 16 may be formed in the cylindrical shape, and the lower end portion of the suction portion 16 may be formed in parallel with the paper sheet P or the transport path of the paper sheet P. Alternatively, the suction portion 16 which is not subjected to the water repellency treatment may be used.

The exhaust duct 15 may be bent, for example, in the X-axis direction in the state in which it is installed to extend in the horizontal direction.

The suction portion 16 may be formed integrally with the exhaust duct 15, or the projection portion 20 which is installed to protrude upwardly from the inner bottom portion of the exhaust duct 15, and the portion extending downwardly from the exhaust duct 15 may be configured as separate members.

In the case where the exhaust ducts configures a portion of the circulation channel, or the like, a fan for moving the air may be provided instead of the exhaust fan 17. In addition, it is possible to suction the mist in the exhaust duct by the pressure difference between the exhaust duct and the inner space communicating with the exhaust duct, without including the exhaust fan 17.

The mist collection device 13 may be disposed at the upstream side of the liquid ejecting head 12 in the transport direction X, or at both sides in the Y-axis direction.

The control of the exhaust fan 17 may not be automatically performed by the control device 50, but be manually performed.

The medium is not limited to the paper sheet, and may be altered by an arbitrary material and shape, such as plastic film, sticker, metal foil, plank, fabric or the like, capable of receiving the liquid.

The printer is not limited to the printer of a line head type. For example, the invention can be applied to a printer of a serial type including a carriage which reciprocates along a scan direction (Y-axis direction which is the width direction of the paper sheet P) intersecting the transport direction X of the medium, and a liquid ejecting head supported by the carriage. In the printer of the serial type, it is possible to effectively recover the mist by disposing a mist collection device, having an exhaust duct extending in the Y-axis direction and the suction portion, at the downstream side of the carriage in the transport direction X. In addition, the suction portion may be disposed at one or both sides of the liquid ejecting head in the scan direction. In this instance, if the exhaust duct is made of a flexible tube, the exhaust fan or the like may not be mounted on the carriage.

In the above-described embodiment, although the liquid ejecting apparatus is embodied in the ink jet printer, the invention may be applied to a liquid ejecting apparatus for ejecting or discharging a liquid other than ink. In addition, the invention may be applied to various liquid ejecting apparatuses including a liquid ejecting head for ejecting a minute number of liquid droplets or the like. In this case, the expression "liquid droplets" means the liquid state ejected from the liquid ejecting apparatus, and includes a liquid having a granular shape, a tear shape, or a thread shape as a trailing shape. Further, herein, the term "liquid" may denote a material which can be ejected from the liquid ejecting apparatus. For example, a liquid-state material may be used, and includes a liquid-state material such as sol or gel water having high or low viscosity, a fluid-state material such as an inorganic solvent, an organic solvent, a fluid, a liquid-state resin, or liquid-state metal (metallic melt), and a material in which particles of a functional material having a solid material such as a pigment or a metal particle are dissolved, dispersed, or mixed with a solvent in addition to a liquid, as one state of a substance. In addition, ink described in the embodiments, liquid crystal or the like may be exemplified as a typical example of the liquid. Here, the ink indicates general water-based ink, oil-based ink, gel ink, or hot-melt ink which contains various liquid compositions. A specific example of the liquid ejecting apparatus may be, for example, a liquid crystal display, an EL (electro-luminance) display, a plane-emission display, a liquid ejecting apparatus for ejecting a liquid containing dispersed or melted materials such as an electrode material or a color material used to manufacture a color filter, a liquid ejecting apparatus for ejecting a biological organic material used to manufacture a biochip, or a liquid ejecting apparatus for ejecting a liquid as a sample used as a precision pipette, a printing apparatus, or a micro dispenser. In addition, a liquid ejecting apparatus for ejecting a lubricant by pinpoint to a precision machine such as a watch or a camera, a liquid ejecting apparatus for ejecting a transparent resin liquid such as a UV-curing resin onto a substrate in order to form a minute hemispherical lens (optical lens) used for an optical transmission element or the like, or a liquid ejecting apparatus for ejecting an etching liquid such as an acid or an alkali in order to perform etching on a substrate or the like may be adopted.

What is claimed is:

1. A line head type printer having a plurality of line heads, the printer comprising:

a first line head;

a first mist collection device dedicated to suctioning and recovering mist generated at the time of ejecting a liquid from the first line head, the first mist collection device is disposed at a downstream side of the first line head in a transport direction of a medium;

a second line head which is disposed at a downstream of the first mist collection device in a transport direction of the medium; and a second mist collection device dedicated to suctioning and recovering mist generated at the time of ejecting a liquid from the second line head, the second mist collection device is disposed at a downstream side of the second line head in the transport direction of the medium, wherein the first mist collection device and the second mist collection device each include an exhaust duct and a suction portion which has a suction port, wherein the mist is recovered to the inside of the exhaust duct through the suction port, a one end portion of the suction portion extends through a hole formed in a bottom portion of the exhaust duct, the suction portion inside the exhaust duct blocks an outflow of liquid from inside of the exhaust duct back through the suction port to the outside of the exhaust duct, the one end portion extending beyond an inner bottom portion of the exhaust duct in a direction of suction opposite to a direction of ejecting the liquid.

2. The line head type printer according to claim 1, wherein a length of the suction portion corresponds to a length of a nozzle row of the line head in the nozzle row direction.

3. The line head type printer according to claim 1, wherein a length of the suction portion in a flight direction of the ejected liquid is shorter than the length of the exhaust duct in the flight direction of the ejected liquid.

* * * * *